United States Patent [19]

Weihe

[11] Patent Number: 4,765,020

[45] Date of Patent: Aug. 23, 1988

[54] SILVERWARE WASHING MACHINE

[76] Inventor: Clyde R. Weihe, 17 Lindberg Ave., Needham Heights, Mass. 02194

[21] Appl. No.: 126,604

[22] Filed: Nov. 30, 1987

[51] Int. Cl.[4] ..... B08B 3/02; A47L 15/42

[52] U.S. Cl. ..... 15/302; 15/3; 15/305; 15/311; 134/57 R; 134/95; 134/99; 134/111; 134/126; 134/131; 134/140; 134/153; 134/155; 134/160

[58] Field of Search ..... 134/57 R, 93, 95, 99, 134/101, 102, 111, 126, 130, 131, 140, 148, 151, 153, 155, 157, 160; 15/3, 302, 305, 308, 311

[56] References Cited

U.S. PATENT DOCUMENTS

| | | | |
|---|---|---|---|
| 1,820,851 | 8/1931 | Trevorrow | 134/160 X |
| 2,212,560 | 8/1940 | Foley | 15/3 |
| 2,600,541 | 6/1952 | Johnson | 134/130 X |
| 2,619,781 | 12/1952 | Buhrer | 134/160 X |
| 4,282,042 | 8/1981 | Tsukamoto | 134/140 |
| 4,456,022 | 6/1984 | Roberts | 134/153 X |

*Primary Examiner*—Philip R. Coe

*Attorney, Agent, or Firm*—M. Lawrence Oliverio

[57] ABSTRACT

A flatware washer comprising a cogged endless belt mechanism mounted lengthwise in a vertical orientation within a water containment housing; the top end of the cogged belt mechanism being hung around a drive wheel mechanism having complementary cogs mating with the cogs of the belt mechanism; the drive wheel mechanism being mounted at the top of the housing and supporting the belt mechanism in a vertical lengthwise orientation such that a curved bottom end section of the belt mechanism is spaced above the bottom edge of the housing and such that a pair of relatively elongated lengthwise sections of the belt extend downwardly from around the drive wheel mechanism in substantially parallel opposing relationship; the curved bottom end section of the hung belt mechanism being open for receiving a plurality of pieces of flatware between the pair of lengthwise sections; the drive wheel mechanism being connected to a drive mechanism programmed to drivably oscillate the wheel mechanism between predetermined degrees of clockwise and counterclockwise rotation; the housing having front and rear walls closely spaced from the front and rear of the curved bottom end section of the hung belt mechanism in substantially perpendicular relationship thereto for containing the plurality of pieces of flatware within the curved bottom end section; a mechanism for directing a spray of fluid at and across the width of the curved bottom end section of the hung belt mechanism; and a mechanism for directing a flow of air across the width of the curved bottom end section of the hung belt mechanism.

14 Claims, 1 Drawing Sheet

SILVERWARE WASHING MACHINE

BACKGROUND OF THE INVENTION

The present invention relates to washing devices for pieces of flatware and in particular to a device for automatically washing rinsing and handling flatware to a degree sufficient to meet the requirements of typical governmental regulations relating to the cleansing and handling of soiled flatware which is used in public restaurants. Flatware is a term which has generally replaced the term silverware to refer to such items as forks, knives, spoons and other similar eating utensils as typically used in restaurants, hospitals, the home and the like.

Prior washers and the like such as shown in U.S. Pat. Nos. 4,126,148 to Norstrom; 4,456,022 to Roberts; 4,551,880 to Johnson; and 4,636,362 to Leister typically rely to a large extent on the jet spray action or other motion of a wash or rinse fluid or a cumbersone, complex mechanical device to effectively cleanse and sterilize any and all surfaces of flatware, dishware and the like which are placed into a washing machine. Such primary reliance on the action or movement of the cleansing or rinse fluids cannot effectively expose all areas of the flatware to the wash or rinse fluids or provide an effective means of delivering the washed and rinsed items of flatware to the operator of the machine such that the operator can effectively avoid having to remove the flatware from the machine without re-contaminating the portions of the flatware which an ultimate user of the flatware might place in his or her mouth.

SUMMARY OF THE INVENTION

The present invention provides a flatware washing device which effectively rotates the flatware and exposes all portions of a plurality of pieces of flatware to a spray of washing and rinse fluid and effectively delivers the cleansed and rinsed flatware to the operator in a manner which minimizes the risk of re-contamination of the flatware by the operator.

In accordance with the invention there is provided a flatware washer comprising a cogged endless belt mechanism mounted lengthwise in a vertical orientation with a water containment housing; the top end of the cogged belt mechanism being hung around a drive wheel mechanism having complementary cogs mating with the cogs of the belt mechanism; the drive wheel mechanism being mounted at the top of the housing and supporting the belt mechanism in a vertical lengthwise orientation such that a curved bottom end section of the belt mechanism is spaced above the bottom edge of the housing and such that a pair of relatively elongated lengthwise sections of the belt extend downwardly from around the drive wheel mechanism in substantially parallel opposing relationship; the curved bottom end section of the hung belt mechanism being open for receiving a plurality of pieces of flatware between the pair of lengthwise sections, the drive wheel mechanism being connected to a drive mechanism programmed to drivably oscillate the wheel mechanism between predetermined degrees of clockwise and counterclockwise rotation; the housing having front and rear walls closely spaced from the front and rear of the curved bottom end section of the hung belt mechanism in substantially perpendicular relationship thereto for containing the plurality of pieces of flatware within the curved bottom end section; a mechanism for directing a spray of fluid at and across the width of the curved bottom end section of the hung belt mechanism; and, a mechanism for directing a flow of air across the width of the curved bottom end section of the hung belt mechanism.

Typically the mechanism for directing the spray of fluid includes a mechanism for automatically alternating between an input of rinse fluid for a second predetermined period of time. The mechanism for directing the spray of fluid typically comprises one or more spray nozzles directed at the open bottom end section, the nozzles being connected to a manifold which is connected to an input source of wash fluid and an input source of rinse fluid.

The drive mechanism is preferably programmed to oscillate the drive wheel mechanism between maximum clockwise and counterclockwise rotations such that no portion of the curved bottom end section of the hung belt means which is contacted by the spray of fluid rotates above about one half up the length of the vertical lengthwise sections.

The washer typically further comprises a mechanism for routing the fluid spray out of the mechanism for directing the spray back to the source of wash fluid. The source of wash fluid preferably includes an overflow drain and a mechanism for returning the wash fluid to the manifold.

The housing is preferably mounted above the supply of wash water, the bottom of the housing including a mechanism for allowing the spray fluid to flow by gravity back into the source of wash fluid, the supply of wash fluid including a mechanism for allowing the fluid draining from the housing to flow into the source of wash fluid.

The belt mechanism is typically mounted within the housing such that the axis of the belt means is tilted forwardly relative to the gravitational horizontal and toward the front of the housing, the forward tilting of the axis of the belt mechanism relative to horizontal being sufficient to allow the plurality of pieces of flatware received within the bottom end section to slide forwardly toward the front wall of the housing under the force of gravity.

The front wall of the housing typically includes a door mechanism positioned adjacent to and extending below the curved bottom end section when in a closed position and allowing the flatware to slide forwardly through an aperture left in the front wall when the door is in an open position. The washer typically further comprises a mechanism for locking and unlocking the door mechanism.

The cogged belt mechanism typically comprises a series of tubes connected to each other in axially parallel relationship to form an endless cogged belt or similar molded plastic belt.

Most preferably the washer further comprises an operation control mechanism including a mechanism for simultaneously activating the drive mechanism and the mechanism for spraying the fluid; and a mechanism for automatically activating the mechanism for directing the flow of air a predetermined amount of time after the mechanism for simultaneously activating has been activated.

The washer may further include an operation control mechanism including a mechanism for simultaneously activating the drive mechanism and the mechanism for successively inputting the fluids; a mechanism for automatically activating the mechanism for directing the flow of air a predetermined amount of time after the mechanism for simultaneously activating has been activated; and, a mechanism for automatically opening the door mechanism a predetermined amount of time after the mechanism for automatically activating the mechanism for directing the flow of air has been activated.

DETAILED DESCRIPTION OF PREFERRED EMBODIMENTS

Following is a description of preferred embodiments of the invention.

Figure 1:
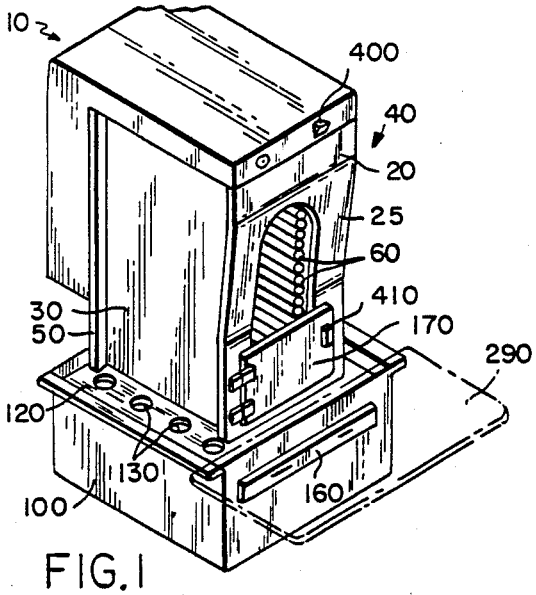
FIG. 1 is an exterior right side isometric view of a flatware washing device according to the invention.

A washing device 10 according to the invention is shown in FIG. 1 having a main housing having a front wall 20, right side wall 30, left side wall 40, and rear wall 50 for housing a driven cogged belt 60 into the open bottom end of which is placed a plurality of pieces of flatware 200 as described more fully hereinafter. The housing 20, 30, 40, 50 is also provided for, among other things, containing a spray of fluid 70, FIG. 2 which emanates from a series of nozzles 80 provided in a common fluid delivery pipe 90, FIGS. 2, 3.

Figure 2:
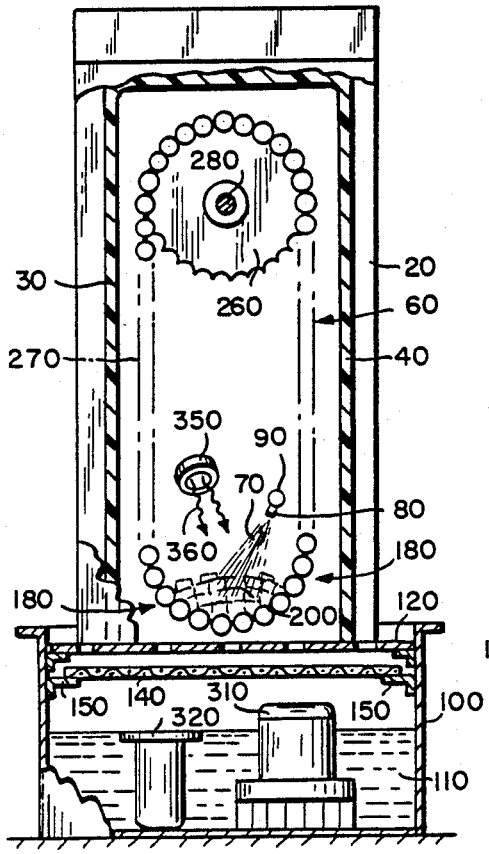
FIG. 2 is a front partial cross-sectional view of the device of FIG. 1.
Figure 3:
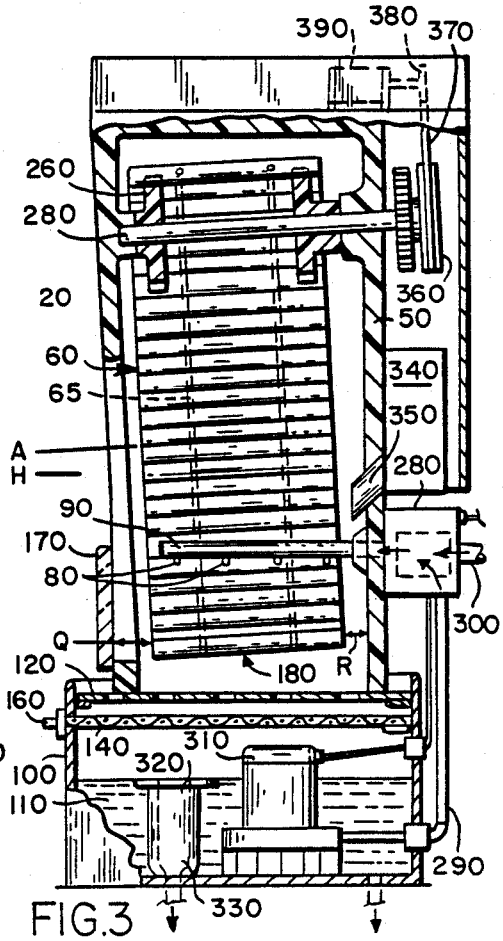
FIG. 3 is a left side, partial cross-sectional view of the device of FIG. 1 showing a forward tilted mounting of a cogged belt within the housing of the device.

The housing structure 20, 30, 40, 50 is typically bottomless and is mounted on top of a tank 100 containing a source of wash fluid 110, FIGS. 1, 2, 3. The tank 100 is typically provided with a top plate 120 having a series of apertures 130 therein for allowing the fluid 70 which emanates from nozzles 80 to ultimately fall by gravity through the open bottom of housing 20, 30, 40, 50, onto the top of plate 120, through apertures 130 and into the main source of wash water 110. In an alternative embodiment the housing 20, 30, 40, 50 may be mounted on a supporting structure (not shown) other than tank 100 and the bottom of the housing provided with a suitable fluid collection structure such as a plate, funnel or the like and a drain mechanism connected via conventional tubing to an appropriate inlet to tank 100. In the specific embodiment shown in FIGS. 1–3, an appropriate filter 140 such as a screen is preferably mounted below the bottom of housing 20, 30, 40, 50. The filter 140 is typically mounted on appropriate channel structures 150 which extend the length of tank 100 beneath support plate 120 and allow filter 140 to be slidably inserted into tank 100. The filter 140 is typically provided with a handle 160 such that the operator may readily slide the filter in and out for cleaning or replacement purposes. The filter 140 is provided for preventing insoluble particles of food matter which may be washed off of the flatware by spray 70 from draining into the source of wash fluid 110 which a more fully described hereinafter is intended to be re-used and re-routed into the housing over extended periods of time and over many separate wash cycles.

Figure 5:
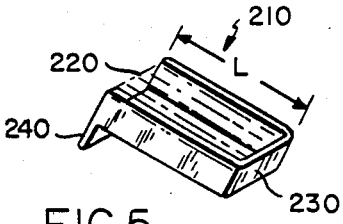

As shown in FIGS. 1–3, the front wall 20 of the housing is provided with a door 170 disposed in front of the curved bottom end 180 of an endless cogged belt 60 which is mounted within housing 20, 30, 40, 50. In operation the door 170 is opened and a plurality of pieces of flatware 200 are loaded into the curved bottom end 180 of the belt 60. In a most preferred embodiment, the loading operation is carried out with a storage and loading tray 210, FIG. 5. As shown in FIG. 5, the tray comprises an open top box-like structure having a length L which is approximately egual to the length(s) of conventionally sized pieces of flatware. Soiled pieces of flatware are loaded into the open top of the tray 210 such that the handle ends of the flatware are disposed toward the downwardly disposed end 230 of the tray 210. The tray 210 is provided with a prop 240 at one end 220 for purposes of preventing the pieces of soiled flatware which are placed into the tray 210 from accidentally falling out of the open end 220 thereof. Once the tray 210 has been appropriately loaded, the tray 210 is manually turned upright and the flatware 200 is allowed to slide out of the open end 220 of the tray 210, through the open door aperture in the front 20 of the housing and into the open curved bottom end 180 of belt 60 as shown in FIG. 2. Such a loading operation results in the handle ends of the flatware 200 being disposed toward the front 20 of the housing and immediately adjacent the door 170 and the door aperture.

As shown in FIGS. 1–3 the front wall door 170 and the rear wall 50 are disposed relatively closely adjacent to the front and rear ends of the curved bottom end 180 of the belt 60, i.e., distances Q and R respectively, FIG. 3, which are typically less than about 1.5 inches, preferably less than about 0.75 inches, such that the flatware 200 which has been loaded into curved section 180 may not slide out of the front or rear end of the bottom end 180 of the belt 60. Typically the distance Q is less than about 0.5 inches and most typically about 0.25 inches or less. Also as shown, the front wall door 170 and rear wall 50 are disposed to the front and rear edges of the curved bottom end 180 of belt 60 such that the flatware 200 is prevented from sliding out of the bottom end 180 along the entire width of the front and rear thereof. As shown in FIGS. 1, 3 the front wall 20 may be provided with a slanted section 25 for more effectively positioning door 170 closely adjacent to the forwardly tilting front edge of bottom section 180.

Figure 4:
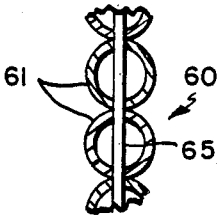
FIG. 4 is a side cross sectional view of a section of a typical cogged belt used in the device of FIGS. 1–3; and, FIG. 5 is a side isometric view of a preferred tray for storing soiled flatware which is to be eventually delivered into the device of FIGS. 1–3.

The belt 60 as shown is cogged such that the cogs therein mate with complementary grooves 250 in drive wheel(s) 260, FIGS. 2, 3. As shown in FIG. 3, drive wheel 260 typically comprises a pair of cogged wheels 260 for appropriate front to back mounting along the width of belt 60. As shown in a cross-section of a small portion of belt 60 in FIG. 4, the belt 60 typically comprises a series of tubes 61 connected to each other by one or more connecting straps 65, FIGS. 3, 4, which are threaded through each successive tube 61 preferably along a cross-sectional diameter line of each tube 61 to form a single endless or continuous belt 60 as best shown in FIG. 2. The individual tubes 61 of the belt 60 are preferably comprised of a high temperature resistant, i.e. above about 100° F., material such as a high temperature resistant dimensionally stable plastic material, metal or the like, e.g. polyvinyl chloride, polypropylene, and the like. Plastic is preferred so as to minimize noise due to the flatware 200 moving along and between the surfaces of the tubes 61. The connecting straps 65 are also preferably comprised of a high temperature resistant plastic material having enough deformability so as to be able to conform to the curve of bottom end 180 and wheel 260, such as a polyurethane, a rubber, elastomer or the like.

As best shown in FIGS. 2, 3 a top end portion of the belt 60 is hung over cogged drive wheels 260 such that a pair of relatively extended vertical lengthwise sections 270 are disposed in substantially parallel relationship to each other within housing 20, 30, 40, 50. In a most preferred embodiment, the belt 60 is hung such that its axis A, FIG. 3, is tilted forwardly relative to a gravitational horizontal H to a degree sufficient to allow the flatware 200 which is loaded in the bottom end 180 to slide forwardly under the force of gravity toward door 170. As shown in FIG. 3 such forward tilt mounting of belt 60 is accomplished by forward tilt mounting of the drive shaft 280 which is connected to and drives drive wheels 260. Alternative methods of forward tilt mounting of belt 60 may be employed such as by forwardly tilting the entire housing 20, 30, 40, 50 or the like. As described more fully hereinafter such forward tilting allows the flatware 200 to be automatically ejected from the bottom end 180 of the belt 60 when the door 170 is automatically opened at the end of a wash cycle. The degree of such forward tilting is typically between about one and about 15 degrees relative to horizontal H, such that the front and rear walls 20, 50 are approximately perpendicular to the front and rear edges of belt 60. Such self ejection when the door 170 is open, thus minimizes the necessity for the operator to handle the flatware 200 and possibly contaminate it prior to use. As shown in FIG. 1, the device is most preferably provided with a tray 290 for receiving the flatware 200 when the door 170 is open. As shown, the tray 290 is disposed below and in front of the door 170. The tray 290 may be mounted or connected to housing 20, 30, 40, 50 or tank 110 or otherwise mounted in any conventional manner.

As shown in FIGS. 2, 3 a common fluid feed pipe 90 is typically mounted between the lengthwise sections 270 with the pipe being provided with nozzles 80 appropriately aligned so as to direct the fluid fed into pipe 90 in the form of a jet spray 70 at the open bottom end section 180 of belt 60. The feed pipe 90 is typically connected to a manifold 280 which, in turn, is connected to a wash fluid inlet pipe 290 and a rinse fluid inlet pipe 300. As described more fully hereinafter a control mechanism (not shown) acts to seguentially activate pump 310 which pumps wash fluid from supply 110 into manifold 200 and subseguently, after a predetermined amount of time, deactivate pump 310 and open a flow valve (not shown) connected to pipe 300 which allows rinse fluid to flow into manifold 280 for a second predetermined amount of time. In a typical embodiment of the invention the wash fluid 110 comprises water containing a conventional detergent and is maintained or otherwise heated to above about 125° F., typically between about 135° and about 160° F. and is pumped or otherwise fed into manifold 280 for less than about 60 seconds, typically about 35–45 seconds; and, the rinse fluid typically comprises a non-detergent containing water, such as fresh water, which is fed into the pipe 300 and typically maintained or otherwise heated to above about 150° F. typically about 180° F., and is fed into pipe 300 for less than about 20 seconds, typically for about 12 seconds, after the control mechanism deactivates pump 310. The rinse fluid may include a chemical sanitizer such as chlorine which may lower the temperature at which the rinse fluid is normally maintained in order to sanitize the flatware, e.g. where a dilute chlorine concentration is used the temperature of the rinse fluid need only be maintained above about 125° F., and typically at about 140° F. to effect an acceptable sanitization of the flatware 200. The rinse water may also include a wetting agent such as a surfactant containing hydroxy groups which is capable of lowering the drying temperature to less than about 130° F. Such a wetting agent is typically included for purposes of eliminating or minimizing spotting of the flatware by droplets of rinse water which may accumulate on certain surfaces of the flatware during the drying cycle.

As described above the spray 70 which emanates from nozzles 80 is eventually routed into tank 100 and mixes with the source of wash fluid 110, FIGS. 1–3. Inasmuch as pump 310 is recirculating the wash fluid 110 between successive cycles and inasmuch as the feeding of new rinse fluid through pipe 300, manifold 280, pipe 90 and nozzles 80 occurs with each wash cycle, overflow drain 320 is provided within tank 110 at a selected height in order to allow the amount of fluid which is fed into manifold 280 during each successive wash cycle in excess of the amount of fluid 110 which reaches the top of the drain 320 to be drained out of tank 100 through drain pipe 330 so as to prevent tank 100 from overflowing. Overflow drain 320 is also provided for purposes of allowing pieces of debris which may be washed down into fluid 110 to be skimmed off the surface of fluid 110 by becoming caught up in the flow of fluid 110 which drains into the top of drain 320. The lip of drain 320 is typically curved such that such debris floating on the surface of fluid 110 may more easily flow into pipe 330.

With each successive wash cycle, wash fluid 110 which contains a predetermined amount of a selected detergent will become more dilute. In a most preferred embodiment of the invention a feed source of detergent (not shown) may be connected to tank 100 and a predetermined amount of detergent fed intermittently into wash supply fluid 110 before, during or after each successive wash cycle. Such successive detergent replenishment may be effected automatically or manually in any conventional manner. Pump 310 comprises a conventional fluid pump such as a water pump and preferably includes a filter (not shown) which filters the fluid 110 before the fluid is intaken by the pump 310. Filter 140 is typically a coarser filter than the filter provided in pump 310.

A hot air blower 340 is provided having a blow pipe or nozzle 350 which directs a stream of hot air 360 at and across the width of the curved bottom end 180 of belt 60, and at any flatware 200 therein, FIGS. 1–3. As shown in FIGS. 2, 3 the nozzle 350, stream of air 360, nozzles 80 and fluid feed pipe 90 are all typically disposed between lengthwise sections 270. As described more fully hereinafter the blower 340 is connected to an operation control device (not shown) which preferably activates the blower upon conclusion of the rinse fluid being fed into pipe 300 during any given cycle and deactivates blower 340 after a predetermined period of time within each wash cycle.

In the specific embodiment shown in FIGS. 2, 3 drive wheels 260 are connected to a drive shaft 280 which in turn is connected to a flywheel 360 having a complementary groove therein for frictional or taut engagement with a drive belt 370 which in turn is frictionally engaged with a motor drive wheel 380 which in turn is driven by a motor 390. Motor 390 is programmed by conventional electromechanical or electronic means to oscillate between predetermined maximum degrees of clockwise and counterclockwise rotation which in turn cause drive wheels 260 to oscillate between predetermined maximum degrees of clockwise and counterclockwise rotation. As described more fully hereinafter motor 390 is connected to an operation control mechanism (not shown) which typically activates motor 390 approximately simultaneously with the activation of pump 310 during any given wash cycle and deactivates motor 390 a predetermined time after drier 340 is deactivated during any given wash cycle.

As drive wheels 260 are drivably oscillated between predetermined maximum degrees of clockwise and counterclockwise rotation, belt 60 is, in turn, drivably oscillated between concomitant predetermined maximum degrees of clockwise and counterclockwise rotation by virtue of the cogged engagement of the belt 60 with the drive wheels 260.

Typically motor 390 is pre-programmed to oscillate a plurality of times between the predetermined maximum of degrees of clockwise and counterclockwise rotation during any single wash cycle, thus drivably causing belt 60 and, a fortiori, the curved bottom end section 180, to oscillate a plurality of times during each cycle. As the belt 60 oscillates the flatware 200 is effectively jostled about and oscillatably turned clockwise and counterclockwise around their axes a plurality of times during each cycle. Such repeated and oscillated rotations of the flatware 200 around their axes effectively and repeatedly exposes all surface areas of each individual piece of flatware 200 to the fluids spray 70 and the stream of hot drying air 360 during each wash cycle and the flatware 200 in contacting each other during rotation provides a burnishing, polishing effect on the flatware 200. The size of the cogs in the belt, e.g. the size of the cross-sectional diameters of the tubes 61, is selected to allow any individual piece of flatware 200 to penetrate along some orientation along its axial length into the recess of a cog such that when the belt 60 and bottom end section 180 rotates, the flatware 200 penetrating the recesses created by the cogs is carried along in the recesses a certain degree during the oscillating belt 60 rotation and ultimately fall under the force of gravity out of such recesses and rotate around their axes as they fall. The pieces of flatware 200 which are not in direct contact with belt 60, are similarly carried along with the rotation of belt 60 to a certain degree and similarly ultimately fall and rotate around their axes as the belt 60 rotates. Such axial rotation of the flatware 200 within bottom section 180 thus effects a burnishing of the flatware 200 such that the flatware is more effectively cleaned and polished.

In a most preferred embodiment of the invention the motor 390 is programmed to oscillate between maximum degrees of clockwise and counterclockwise which are predetermined to limit the maximum oscillating rotation of the belt 60 such that the bottom end section 180, and any other sections of the belt 60, which is or are contacted by the spray 70 during a wash cycle, do not ever oscillatably rotate so far as to engage drive wheels 260. Such limitation of the maximum rotation of the belt 60 thus minimizes or eliminates the possibility that any wash fluid and, a fortiori, any detergent will drip back down onto flatware 200 during a wash cycle and particularly during the drying period or otherwise after the rinse period has elapsed during a wash cycle. Most preferably the maximum degree of rotation of belt 60 is limited such that the bottom end section 180 reaches up to a maximum height of less than about $\frac{3}{4}$ up the length of vertical sections 270, FIG. 2, and most preferably less than about $\frac{1}{2}$ up the length of vertical sections 270.

In summary of a most preferred operation of device 10, a switch activation button 400, FIG. 1, is provided for starting an individual wash cycle. Switch 400 is connected to an operation control mechanism (not shown) which typically includes a conventional timer for controlling the seguence of activation and deactivation of the various elements of the device 10. As described above the flatware 200 is loaded from tray 210 into the bottom end section 180 and the door 170 is closed up against the face of front wall 20. A magnetic latch (not shown) is typically provided on the face of wall 20 which interacts with a complementary magnet provided on the rear face of door 170 behind handle 410. When the switch 400 is actuated, the timer first simultaneously activates motor 390, pump 310 and the magnetic latch. The timer is programmed or otherwise pre-set to deactivate pump 310 and simultaneously activate a valve or other conventional mechanism which allows rinse water to flow into pipe 300 after a first predetermined period of time has elapsed, for example about 40 seconds after the switch 400 has been actuated.

The timer is similarly programmed or otherwise preset to deactivate or otherwise close the rinse water valve and simultaneously activate blower 340 after a second predetermined period of time has elapsed, for example about 12 seconds after the pump 310 has been deactivated.

The timer is similarly programmed or otherwise preset to deactivate blower 340 and simultaneously deactivate the magnetic latch (not shown) which holds door 170 closed after a third predetermined period of time has elapsed, for example about 0–60 seconds after the rinse water valve (not shown) has been closed. Upon deactivation of the magnetic latch, the weight of the flatware which is slidably tilted forward by the tilted bottom end 180 against the rear face of door 170, causes door 110 to open and the flatware 200 slides forwardly under its own weight through the open door and onto tray 290 fully cleansed, rinsed and dried.

Most preferably the timer is programmed or otherwise pre-set to deactive the motor 390 after a fourth predetermined period of time has elapsed, for example about 1–10 seconds after the magnetic latch has been deactivated. The motor 390 and belt 60 thus preferably continue to oscillate and jostle the flatware for some period of time after the door 170 has been released. Such delayed deactivation of motor 390 thus assists in allowing the flatware 200 to self eject from the bottom end section 180 by continuing a jostling of the flatware 200 which assists in overcoming any static friction which might otherwise cause flatware 200 to resist sliding forwardly out of bottom end section 180.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of eguivalents.

What is claimed is:

1. A flatware washer comprising:

a cogged endless belt means mounted lengthwise in a vertical orientation within a water containment housing;

the top end of the cogged belt means being hung around a drive wheel means having complementary cogs mating with the cogs of the belt means;

the drive wheel means being mounted at the top of the housing and supporting the belt means in a vertical lengthwise orientation such that a curved bottom end section of the belt means is spaced above the bottom edge of the housing and such that a pair of relatively elongated lengthwise sections of the belt extend downwardly from around the drive wheel means in substantially parallel opposing relationship;

the curved bottom end section of the hung belt means being open for receiving a plurality of pieces of flatware between the pair of lengthwise sections;

the drive wheel means being connected to a drive means programmed to drivably oscillate the wheel means between predetermined degrees of clockwise and counterclockwise rotation;

the housing having front and rear walls closely spaced from the front and rear of the curved bottom end section of the hung belt means in approximately perpendicular relationship thereto for containing the plurality of pieces of flatware within the curved bottom end section;

means for directing a spray of fluid at and across the width of the curved bottom end section of the hung belt means; and, means for directing a flow of air across the width of the curved bottom end section of the hung belt means.

2. The washer of claim 1 wherein the means for directing the spray of fluid comprises a means for automatically alternating between an input of wash fluid for a first predetermined time and an input of rinse fluid for a second predetermined period of time.

3. The washer of claim 2 wherein the means for directing the spray of fluid comprises one or more spray nozzles directed at the open bottom end section, the nozzles being connected to a manifold which is connected to an input source of wash fluid and an input source of rinse fluid.

4. The washer of claim 3 further comprising means for routing the fluid sprayed out of the means for directing the spray back to the source of wash fluid.

5. The washer of claim 4 the source of wash fluid includes an overflow drain and a means for returning the wash fluid to the manifold.

6. The washer of claim 5 wherein the housing is mounted above the supply of wash water, the bottom of the housing including means for allowing the sprayed fluid to flow by gravity back into the source of wash fluid, the supply of wash fluid including means for allowing the fluid draining from the housing to flow into the source of wash fluid.

7. The washer of claim 2 wherein the drive means is programmed to oscillate the drive wheel means between maximum clockwise and counterclockwise rotations such that no portion of the curved bottom end section of the hung belt means which is contacted by the spray of fluid rotates about one-half up the length of the vertical lengthwise sections.

8. The washer of claim 1 wherein the drive means is programmed to oscillate the drive wheel means between maximum clockwise and counterclockwise rotations such that no portion of the curved bottom end section of the hung belt means which is contacted by the spray of fluid rotates above about one-half up the length of the vertical lengthwise sections.

9. The washer of claim 1 wherein the belt means is mounted within the housing such that the axis of the belt means is tilted forwardly relative to horizontal and toward the front of the housing, the forward tilting of the axis of the belt means relative to horizontal being sufficient to allow the plurality of pieces of flatware received within the bottom end section to slide forwardly toward the front wall of the housing under the force of gravity.

10. The washer of claim 9 wherein the front wall of the housing includes a door means positioned adjacent to and extending below the curved bottom end section of the belt means, the door means containing the flatware within the curved bottom end section when in a closed position and allowing the flatware to slide forwardly through an aperture left in the front wall when the door is in an open position.

11. The washer of claim 10 further comprising means for locking and unlocking the door means and means for successively inputting a wash fluid and a rinse fluid into the means for directing the spray.

12. The washer of claim 11 further comprising an operation control means including:

means for simultaneously activating the drive means and the means for successively inputting the fluids;

means for automatically activating the means for directing the flow of air a predetermined amount of time after the means for simultaneously activating has been activated; and, means for automatically opening the door means a predetermined amount of time after the means for automatically activating the means for directing the flow of air has been activated.

13. The washer of claim 1 wherein the cogged belt means comprises a series of tubes connected to each other in axially parallel relationship to form an endless cogged belt.

14. The washer of claim 1 further comprising an operation control means including:

means for simultaneously activating the drive means and the means for spraying the fluid; and, means for automatically activating the means for directing the flow of air a predetermined amount of time after the means for simultaneously activating has been activated.

* * * * *